US007019646B1

(12) United States Patent
Woodard et al.

(10) Patent No.: US 7,019,646 B1
(45) Date of Patent: Mar. 28, 2006

(54) COMBINATION SMOKE ALARM AND WIRELESS LOCATION DEVICE

(76) Inventors: Noel Woodard, P.O. Box 19646, Seattle, WA (US) 98109; Jon Woodard, P.O. Box 19646, Seattle, WA (US) 98109

( * ) Notice: Subject to any disclaimer, the term of this patent is extended or adjusted under 35 U.S.C. 154(b) by 73 days.

(21) Appl. No.: 10/660,244

(22) Filed: Sep. 11, 2003

Related U.S. Application Data

(60) Provisional application No. 60/416,970, filed on Oct. 8, 2002, provisional application No. 60/416,971, filed on Oct. 8, 2002.

(51) Int. Cl.
*G08B 1/08* (2006.01)

(52) U.S. Cl. ..... 340/539.26; 340/628; 340/815.4

(58) Field of Classification Search ..... 340/539.26, 340/630, 539.1, 628, 629, 426.19, 539.13, 340/539.18, 527, 815.4, 384.1
See application file for complete search history.

(56) References Cited

U.S. PATENT DOCUMENTS

| | | | | |
|---|---|---|---|---|
| 5,019,805 | A | 5/1991 | Curl | 340/628 |
| 5,283,816 | A | 2/1994 | Gomez Diaz | 379/40 |
| 5,587,705 | A | 12/1996 | Morris | 340/628 |
| 5,949,332 | A * | 9/1999 | Kim | 340/539.27 |
| 5,960,061 | A * | 9/1999 | Fahie et al. | 379/37 |
| 6,073,004 | A | 6/2000 | Balachandran | 455/404.2 |
| 6,121,885 | A * | 9/2000 | Masone et al. | 340/628 |
| 6,184,829 | B1 | 2/2001 | Stilp | 342/387 |
| 6,317,604 | B1 | 11/2001 | Kovach | 455/456 |
| 6,323,803 | B1 | 11/2001 | Jolley | 342/357.03 |
| 6,329,904 | B1 * | 12/2001 | Lamb | 340/286.02 |
| 6,353,412 | B1 | 3/2002 | Soliman | 342/387 |
| 6,362,743 | B1 | 3/2002 | Tanguay | 340/630 |
| 6,380,860 | B1 * | 4/2002 | Goetz | 340/586 |
| 6,437,692 | B1 * | 8/2002 | Petite et al. | 340/540 |
| 6,829,478 | B1 * | 12/2004 | Layton et al. | 455/428 |
| 2001/0024163 | A1 * | 9/2001 | Petite | 340/628 |
| 2003/0081735 | A1 * | 5/2003 | Emory et al. | 379/1.01 |

* cited by examiner

*Primary Examiner*—Phung T. Nguyen
(74) *Attorney, Agent, or Firm*—Seed IP Law Group PLLC

(57) ABSTRACT

The present disclosure relates to a device and method for determining and automatically transmitting a geographic location of a wireless smoke alarm during a potential fire emergency. The wireless smoke alarm includes a smoke alarm interfaced with a wireless transceiver, which operates over an existing wireless telecommunications network. The wireless transceiver can be a cellular processor with an integrated memory for storing emergency identification data. In one mode of operation, upon sensing the presence of smoke, the wireless transceiver automatically transmits stored emergency identification data signals to a dispatch center.

20 Claims, 4 Drawing Sheets

COMBINATION SMOKE ALARM AND WIRELESS LOCATION DEVICE

CROSS REFERENCE TO RELATED APPLICATIONS

This application claims the benefit of Provisional Patent Application Ser. No. 60/416,970, filed Oct. 8, 2002, and Provisional Patent Application Ser. No. 60/416,971, filed Oct. 8, 2002 where these two provisional applications are incorporated herein by reference in their entireties.

BACKGROUND OF THE INVENTION

1. Field of the Invention

This disclosure relates generally to smoke alarms and wireless telecommunications systems. More specifically, this disclosure provides a combination device and method for locating a smoke alarm utilizing wireless E-911 telecommunication location systems.

2. Description of Related Art

Smoke Alarm Devices and Systems

Smoke alarm devices and systems are valuable fire protection tools that save life and property. Detecting smoke at the earliest stages of a fire, alerting building occupants for rapid, evacuation, and notifying emergency response resources of the fire are key factors for any general fire safety plan. However, failure of any one of the key factors increases the fire danger. Preparing for fire scenarios, reducing physical injury, reducing loss of life, and reducing property damage are all dependent upon building occupants safely evacuating a burning building and quickly contacting emergency response personnel.

One type of smoke alarm device is a self-contained, independent smoke alarm unit with photoelectric, ionization, or both types of sensors to detect smoke, provide an AC and/or DC power source, and provide an audible alarm horn and/or visual alarm signal to alert building occupants of a potential fire. For example, a FIRST ALERT® SA302 smoke alarm provides both photoelectric and ionization sensors in one unit. A GENTEX® DL2220 smoke alarm features an ADA-compliant 90 dB audible alarm horn and 177 candela strobe light for hearing impaired persons.

One drawback of such self-contained units is that these units do not communicate with each other. For instance, in larger buildings containing many rooms or multiple levels, even when equipped with multiple self-contained smoke alarm units, the self-contained smoke alarm may detect smoke and fire in remote or unoccupied areas for unknown periods of time before the occupants are alerted to the fire, which allows the fire to spread. Furthermore, physically-challenged, intoxicated, or sleeping occupants may not hear or otherwise respond to the audible or visual alarm of the self-contained unit located in a remote part of the building before being overcome by smoke inhalation. These drawbacks substantially increase the fire danger to occupants, property, and emergency response personnel. Thus, self-contained smoke alarms have serious limitations relating to alerting building occupants, who are in turn responsible for contacting emergency response personnel.

In response to the above, some federal, state, and/or local fire codes may require that new residences incorporate multiple, self-contained smoke alarms equipped with hard-wired interconnection terminals forming a network and thus permitting the activation of multiple smoke alarms. The interconnection terminals allow multiple smoke alarms to be interconnected within a building, so when any one of the interconnected smoke alarm senses smoke, other interconnected alarm are activated. One example of a networked smoke alarm system is described in U.S. Pat. No. 6,362,743. The FIRST ALERT® SA4121 smoke alarm also provides interconnection terminals.

Another type of smoke alarm system utilizes wireless interconnections to permit communication between the smoke alarms. However, this system requires short-range transceivers to transmit the wireless signal to/from other smoke alarms. One wireless smoke alarm system that provides a multiple alert smoke alarm in which two or more smoke alarms containing wireless FM transmitters provide multiple alarm activation is described in U.S. Pat. No. 5,587,805. A similar system is described in U.S. Pat. No. 5,019,805, which describes a smoke alarm featuring an interconnection via an AC power line carrier signal and interconnection via wireless signals.

Although interconnected smoke alarms may alert building occupants to fires in remote or unoccupied areas, if the building is unoccupied or vacant, the fire will go undetected, which may allow the fire to spread. Neighbors or other observers would have to notice the burning building and contact the emergency response personnel.

Other types of hard-wired or wireless interconnected smoke alarm systems are typically integrated with residential or commercial building security systems, which are primarily designed for intrusion detection and home automation. For example, a smoke alarm system called the NAPCO® GEMINI® system provides a modular residential security system comprising a separate wall-mounted control panel, a keypad, a wireless receiver, various wireless security sensors, and a wireless smoke alarm. The GEMINI® system may also include a telephone auto-dialer connected to a "wireless" telephone, which is configured to automatically notify a commercial security monitoring service upon activation.

Integrated security systems that include smoke alarms can be cost prohibitive if the primary goal of the building owner is to monitor for fire. Also, integrated security systems require skilled technicians to install, test, and maintain the entire system. In addition to the system complexity, installation, and maintenance costs, the integrated security system may not include a smoke alarm in the basic system configuration. Further, the integrated security system often requires an additional telephone line, requires an off site commercial security monitoring service, and requires the payment of monthly service fees.

Another drawback of the aforementioned smoke alarm devices and systems is that they are not designed for installation in buildings that are under construction or otherwise unoccupied. Workers at a construction site and/or persons in the immediate vicinity are the primary means for noticing a potential fire. Because unoccupied buildings are typically vacant during off-work hours, a fire may cause increased damage to the building, increased damage to adjacent properties, and/or pose an increased danger to emergency response personnel.

Another drawback of some self-contained and interconnected smoke alarms is the lack of effective means for automatically notifying emergency response personnel of the specific location of the fire emergency. Direct contact with a public 911 dispatch center, often referred to as a Public Safety Answering Point ("PSAP"), can be a factor in the response time of the emergency response personnel.

For example, during a fire emergency, evacuating building occupants are faced with sudden conflicting decisions, which include immediately evacuating the burning building, helping others to evacuate safely, gathering valuable property, or calling 911 to report the fire and summon emergency response resources.

In most cases, building occupants calling 911 in a fire emergency will use a conventional wireless telephone or a mobile cellular telephone to call 911. In such a situation, the caller may be in a heightened state of anxiety and confusion, so locating a telephone, dialing the number, waiting for a call connection, and articulating the nature of the emergency to a 911 dispatcher can waste critical evacuation time. These complexities place children, the elderly, and the handicapped at high risk.

Therefore, a need exists to provide a smoke alarm that automatically notifies a 911 dispatch center and automatically provides a geographic location of the emergency.

Wireless Telecommunication Systems, Mobile Cellular Telephones, and Emergency 911 Systems.

The existence of wireless telecommunications network systems, often referred to as cellular networks, along with mobile cellular telephones, are well known.

Due to a dramatic increase in 911 calls originating from mobile cellular telephones, wireless E-911 needed to be modified to provide a callback number, fixed address and/or geographic location information of mobile cellular telephone. Although the majority of wireless telephones in the United States have wireless E-911 capabilities, mobile cellular telephones do not.

Recognizing the proliferation of cellular phones, the Federal Communications Commission ("FCC") enacted a regulation requiring wireless telecommunications carriers to upgrade and modify their wireless network infrastructure and cellular phone capabilities. The resulting system is known as a wireless telecommunications location system ("WTLS"), which allows an emergency response authority to automatically determine the geographic location of a mobile cellular telephone, and possibly even track the movements of the cellular phone during an emergency call. Accordingly, a new wireless location concept, called wireless Enhanced 911 ("wireless E-911") service is being deployed nationwide. In addition, dispatch centers may be equipped with a modified Geographic Information System ("GIS") that displays city or county maps and other information, to automatically pinpoint the geographic location of the wireless 911 caller. The emergency personnel may then be dispatched to the location of the cellular phone. Wireless E-911 is designed to save lives by reducing the response time and increasing the accuracy of emergency response resources responding to emergency calls. One system that uses wireless E-911 capabilities is described in U.S. Pat. No. 6,317,604.

Numerous wireless E-911 location concepts exist in the prior art to achieve WTLS capabilities. The numerous concepts include measuring the time difference of arrival and angle of arrival of signals transmitted from mobile cellular telephones to base station antennas. These concepts generally require a plurality of base station antennas to "triangulate" the signal transmission to determine the geographic location. These concepts operate best when there is a high concentration of base station antenna sites. Otherwise, increasing wireless transceiver amplifier output, or other supplemental means may be needed. One type of a base station antenna system is described in U.S. Pat. No. 6,184,829. These wireless location concepts may be governed by the FCC wireless E-911 Phase II network-based regulatory mandate requiring a WTLS to locate a wireless E-911 caller within 100 meters for 67% of calls, and/or within 300 meters for 95% of the calls.

One approach to identifying the location of a cellular phone is by integrating a Global Positioning System ("GPS") receiver into the cellular phone. GPS is a popular satellite-based navigation system that provides coded satellite signals that are processed in a GPS receiver to yield the position and velocity of the receiver. This location method generally requires a line-of-sight signal transmission of a plurality of GPS satellites to determine the coordinates of the GPS receiver. A cellular phone that incorporates a GPS receiver is described in U.S. Pat. No. 6,353,412. According to an FCC regulation, a cellular phone with an integrated GPS receiver must provide a location accuracy within 50 meters for 67% of the calls, and/or within 150 meters for 95% of the calls.

Hybrid wireless locations concepts that combine the above-stated network and handset-based locations concepts exist to reduce the number of base station antenna sites and GPS satellites needed to locate a mobile cellular telephone. These hybrid location concepts may utilize augmented GPS (e.g., assisted GPS, differential GPS), or synchronize the GPS satellites and WTLS base station sites, offering a faster location process. A similar wireless location concept is described in U.S. Pat. No. 6,323,803. Hybrid location concepts may exceed FCC wireless E-911 regulatory mandates by increasing location accuracy and reducing location determination time.

Certain basic technical aspects have an essential role in WTLS. Generally, air interface protocols (e.g., TDMA, CDMA, GSM, GPRS, AMPS, N-AMPS) and relative frequencies operate in conjunction with a wireless telecommunications transceiver (hereinafter referred to as a "wireless transceiver")—an essential component of a mobile cellular telephone—to transmit signals over the WTLS for location determination. All air interface protocols primarily utilize two types of "channels" for wireless signal transmission.

The first type is a control channel, which is typically used for transmitting general identifying information pertaining to the wireless transceiver transmitting the signal. The second type is a voice channel, used primarily for voice communications. Because a voice channel typically does not provide identification information of the wireless transceiver, control channels are often used for wireless location purposes.

In addition, the latest technology allows a wireless transceiver to contain a fully integrated "system on a chip." In one embodiment, the wireless transceiver is of a dual-band and/or dual-mode configuration (e.g., GSM/GPRS) to optimize voice communications, text messaging (i.e., Short Message Service ("SMS")), and Multi-Media Service ("MMS"), and contain on-chip memory capabilities. Further, Personal Digital Assistants ("PDA's") include wireless transceivers. PDA's may also integrate wireless local-area network ("W-LAN") modules for wireless data communications with other PDA's or personal computers.

Additional FCC regulations include providing wireless "priority access" service to federal, state, and local public safety and emergency response personnel utilizing mobile cellular telephones. Wireless priority access service provides public safety authorities priority access on wireless telecommunications network systems during widespread emergencies, when the number of calls exceeds the system call capacity. Priority access service could also provide benefits for wireless E-911 location services.

One drawback of the aforementioned wireless location concept is that it is primarily designed for determining the geographic location of voice-only mobile cellular telephones. The intended use of wireless E-911 location requires the caller to manually enter the "9-1-1" numeric sequence or some variation into the cellular handset keypad. Once a connection is made, the user must then verbally articulate the nature of the emergency to a 911 dispatch center. Although mobile cellular telephones are an important tool for general safety and emergency reporting, they still require a human user to operate, and are not specially designed for fire safety.

Another drawback is that in order to utilize wireless E-911 emergency location services, a user must first purchase or acquire a non-operational mobile cellular telephone, and then enter into a service contract with a wireless telecommunications carrier, which requires an activation fee and monthly service fee. To help alleviate this problem, the FCC issued an order entitled, "Enhanced 911 Emergency Calling Use of Non-initialized Wireless Phones," which provides for "911 only" mobile cellular telephones to have basic wireless E-911 functionality without requiring the cellular owner to enter into a service contract with a wireless carrier, pay an activation fee, and pay monthly service fees. However, these mobile cellular telephones are not specialized for fire safety.

As described above, presently available conventional smoke alarms are primarily used for alerting building occupants with an audible or visual alarm, but do not provide a means to automatically and directly contact a 911 dispatch center. Therefore, in light of the foregoing disadvantages inherent in prior art smoke alarms, a need exists for a new and improved combination smoke detection device that automatically detects fire emergencies, automatically determines the geographic location of the fire emergency, and automatically contacts an emergency dispatch center to warn of a fire emergency situation.

SUMMARY OF THE INVENTION

A wireless smoke alarm device provides a method to quickly, efficiently, and cost effectively detect the presence of smoke, alert building occupants of a fire emergency, and transmit emergency identification data signals, which may include a geographic location of the fire emergency.

The wireless smoke alarm is an integrated unit comprising a wireless transceiver, a smoke alarm, and a smoke sensor. Activation of the smoke sensor triggers the smoke alarm and further activates the wireless transceiver. The wireless transceiver then automatically transmits data to an emergency dispatch center. The transmitted data may include the geographic location of the fire emergency.

In one embodiment, the wireless transceiver includes an integrated memory with preprogrammed or predetermined emergency identification data. The emergency identification data may be stored in the wireless transceiver at either the factory-level, carrier-level, or at the point-of-sale.

One advantage of the wireless smoke alarm is that the wireless smoke alarm substantially reduces the concern of immediately locating a telephone to call 911 during a fire incident. Thus, the building occupants can safely and expeditiously evacuate the building, which reduces the risk of physical injury.

Another advantage is that the wireless smoke alarm transmits data to an emergency dispatch center at the time the smoke is detected, which reduces the response time for the emergency response personnel.

Yet another advantage is that the wireless smoke alarm provides fire protection to building structures that are unoccupied, vacant, undergoing construction, or without wireless telephone service. In addition, the wireless smoke alarm provides extended protection to residential buildings that house the elderly, handicapped, hearing impaired, and/or other persons whom may have some difficulty reacting to a fire emergency.

Along with the described embodiments and aspects of the wireless smoke alarm, the wireless smoke alarm can include a GPS receiver interfaced with the wireless transceiver to provide the means for obtaining the geographic location of the fire emergency; a communication link to a wireless local area network to connect multiple smoke alarms; a strobe light for generating a visual alarm; a radio frequency signal strength meter; an AC/DC power management transformer system for primary and back-up power; a disable button for temporarily disabling the alarm; a time delay control circuit with a selector switch for temporarily delaying the alarm, a wireless enhanced 9-11 service; encoding capabilities; and/or any combination of the above.

Merging the concepts of wireless E-911 location systems, mobile cellular telephones, and smoke alarm devices provides the general public and public safety authorities with an effective tool in the ongoing effort of protecting the public—by saving life and property from the ravages of fire.

In one aspect, a smoke alarm device includes a smoke sensor to sense a threshold of smoke; an alarm control circuit in communication with the smoke sensor, the alarm control circuit configured to generate a signal when the alarm control circuit is activated by the smoke sensor upon the smoke sensing the threshold of smoke; and a wireless transceiver having an integrated memory that includes an enhanced 911 feature with emergency identification data, the transceiver coupled with the alarm control circuit to automatically transmit the emergency identification data to a dispatch center upon receiving the signal from the alarm control circuit, wherein the emergency identification data includes a geographic location of the wireless transceiver.

In another aspect, a method for notifying a dispatch center of an emergency condition includes sensing a predetermined threshold of smoke with a smoke sensor; activating an alarm with an alarm control circuit, the alarm control circuit in communication with the smoke sensor and configured to be activated upon the smoke sensor sensing the threshold of smoke; generating an alarm signal from the alarm control circuit; receiving the signal with a wireless transceiver coupled to the alarm control circuit, the wireless receiver having an integrated memory that includes an enhanced 911 feature; and automatically transmitting an amount of emergency identification data from the wireless transceiver to a dispatch center, wherein the emergency identification data includes a geographic location of the wireless transceiver.

In yet another aspect, a wireless smoke alarm to transmit data to a dispatch center includes an integrated memory having an enhanced 911 service; a sensor configured to generate a signal when an amount of smoke is detected; an alarm control circuit in communication with the sensor and configured to receive the signal from the sensor; and a transmitter in communication with the integrated memory and the alarm control circuit, the transmitter configured to automatically and contemporaneously transmit at least a geographic location of the wireless smoke alarm of to a dispatch center upon an activation of the alarm control circuit.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE EMBODIMENTS

In the following description, certain specific details are set forth in order to provide a thorough understanding of various embodiments. However, one skilled in the art will understand that the embodiments may be practiced without these details. In other instances, well-known structures associated with smoke alarms and wireless networks have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

The headings provided herein are for convenience only and do not interpret the scope or meaning of the claimed invention.

Figure 1:
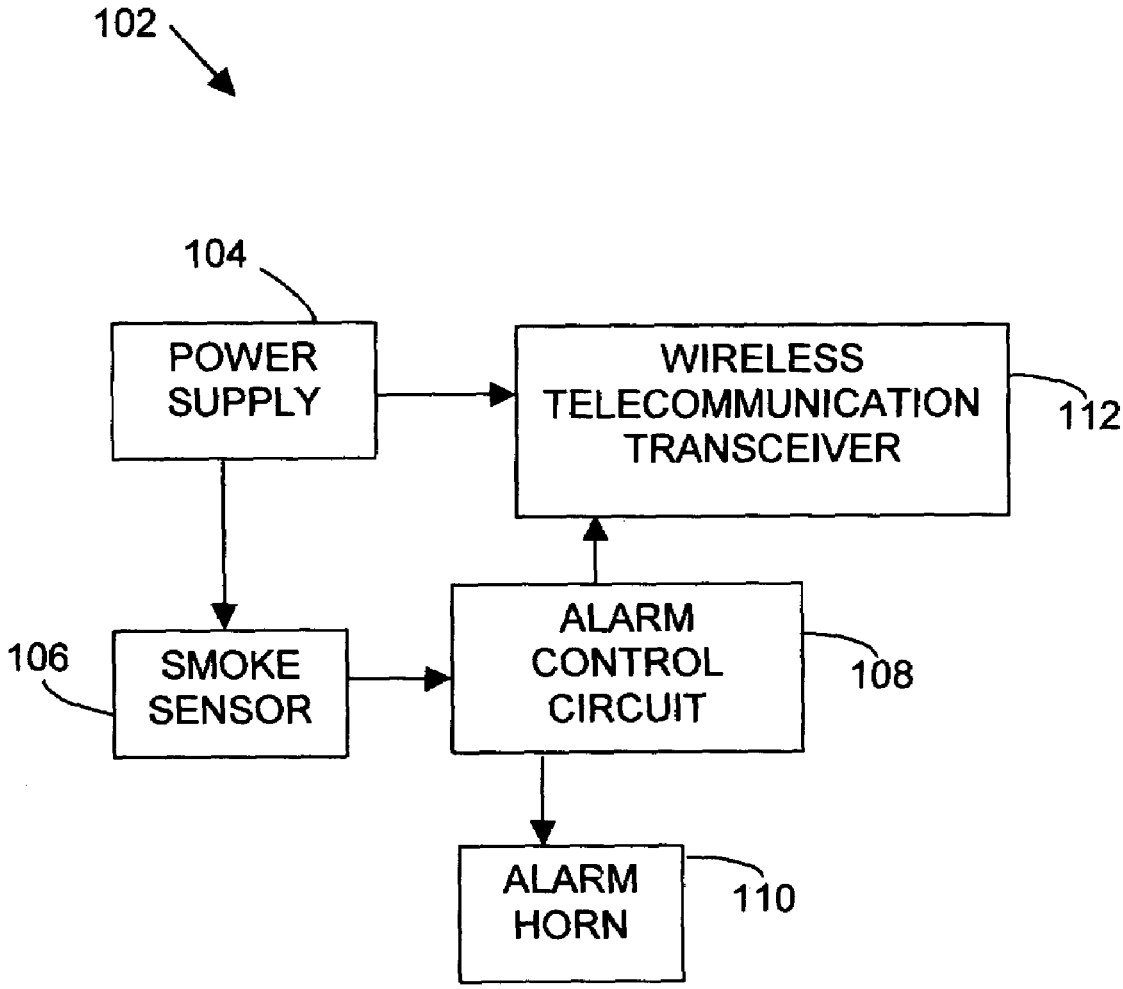
FIG. 1 is a block diagram illustrating a wireless smoke alarm according to one embodiment.

One embodiment of the wireless smoke alarm is shown as a unit 102 in FIG. 1. The unit 102 can be fixed-mounted to a wall, ceiling, or other surface within a building structure in which smoke detection is desired.

A power supply 104 provides power to the unit 102 and can be AC power, DC power, or both. A smoke sensor 106 includes a photoelectric sensor, an ionization sensor, or both. An alarm control circuit 108 is coupled to and in communication with the smoke sensor 106. The alarm control circuit 108 generates an alarm signal upon detecting a threshold of smoke. An audible alarm horn 110 is coupled to the alarm control circuit 108.

A wireless transceiver 112 is a cellular processor with an integrated memory that includes preprogrammed or predetermined emergency identification data. The wireless transceiver 112 may be configured to transmit the emergency identification data signals via a control channel and may also be configured with an amplifier.

The emergency identification data stored in the wireless transceiver 112 includes a means for contacting a 911 dispatch center, which may be alternatively referred to as a "Public Safety Answering Point" (PSAP). In addition, the emergency identification data may include parameters describing the nature of the fire emergency. The emergency identification data may be preprogrammed at the factory-level, carrier-level, or at the point of sale into the wireless transceiver 112. The emergency identification data may also include priority access capabilities.

In one embodiment, the emergency identification data may be similar to the preprogrammed data stored in non-service initialized 911-only mobile cellular telephones, which can include device identification data such as the FCC's proposed consecutive number code "123-456-7890" and/or other device-specific data. In another embodiment, the emergency identification data includes the Emergency Services Interconnection Forum proposed Annex C J-STD-036, which is a coded sequence of "911" followed by part of the wireless transceiver's Electronic Serial Number, and/or an International Mobile Station Equipment Identity.

During operation, the unit 102 is powered by the electrical power supply 104 and is in a monitoring mode. If the smoke sensor 106 detects the threshold of smoke, the alarm control circuit 108 is set into an activation mode, which triggers the audible alarm horn 110 for as long as the threshold of smoke is being detected. The audible alarm horn 110 emits a continuous high-decibel tone to alert building occupants of an impending fire emergency. In one embodiment, the wireless transceiver 112 "auto-dials" and transmits the emergency identification data over a communications network to a dispatch center. In another embodiment, the wireless transceiver 112 "auto-dials" and transmits the emergency identification data directly to the dispatch center.

Figure 2:
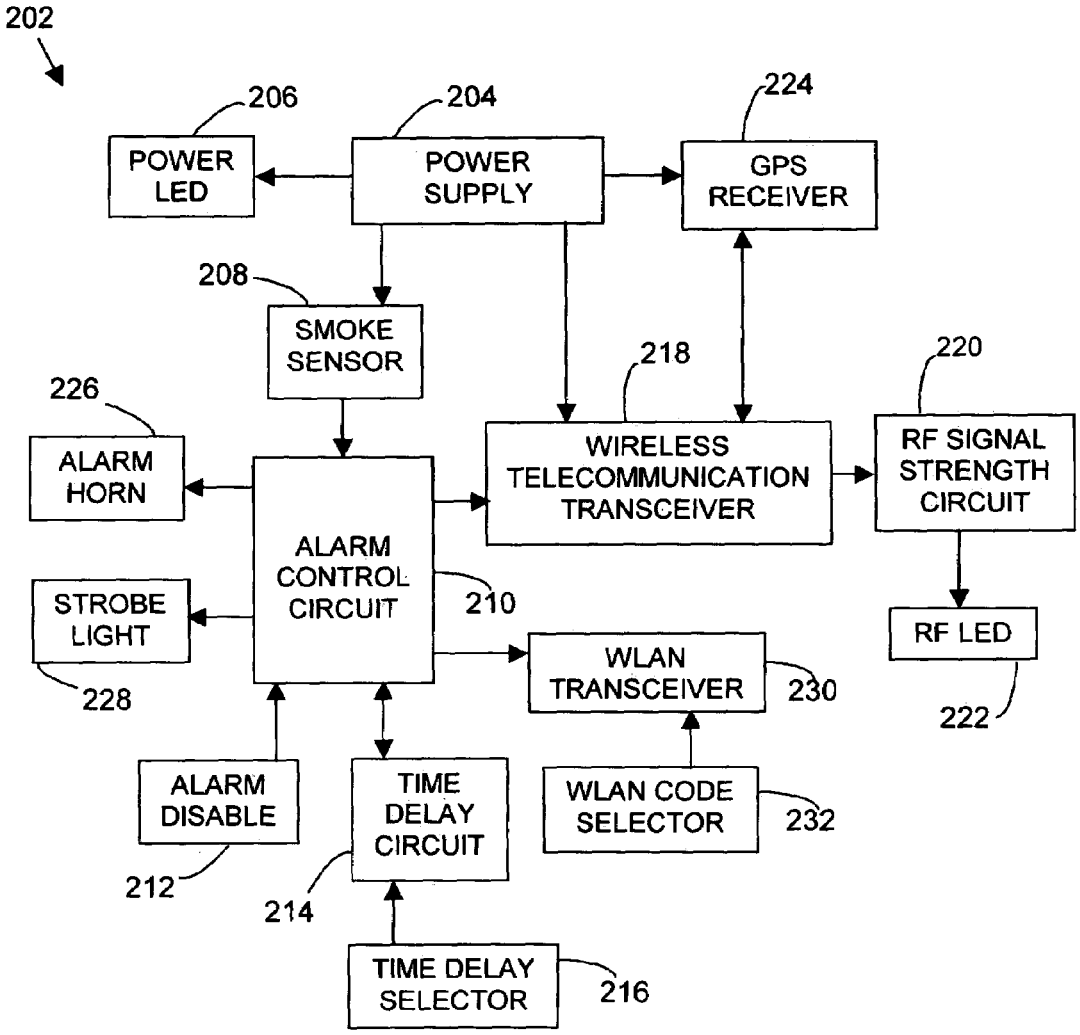
FIG. 2 is a block diagram illustrating the wireless smoke alarm of FIG. 1 with added components according to one illustrated embodiment.

The wireless smoke alarm 202, shown in FIG. 2, is similar to unit 102, but comprises additional features. The unit 202 is contained in a housing, which can be fixed-mounted to a wall, ceiling, or other surface.

A power supply 204 provides power to the unit 202. The power supply 204 may operate with AC power, DC power or an AC/DC power management and transformer, which provides AC power converted to DC power. DC power can be stored in a rechargeable DC battery in the event AC power is interrupted. A power LED 206 is coupled to the housing for visually monitoring a level of AC or DC power.

A smoke sensor 208 and an alarm control circuit 210 are configured as discussed above.

In one embodiment, an alarm disable button 212 coupled with the alarm control circuit 210 allows a user to temporarily disable the alarm control circuit 210 for an amount of time. The alarm disable button 212 may include a default mode that renders it inoperable beyond a predetermined number of uses.

In yet another embodiment, a time delay control circuit 214 and time delay selector switch 216 are coupled to the alarm control circuit 210. The time delay selector switch 216 is a user-set switch allowing multiple predetermined time settings, which when set by a user, sets the time delay control circuit 214, which places the alarm control circuit 210 into a time delay operation mode. The time delay operation mode will delay the transmission of an activation signal generated by the alarm control circuit 210 to at least the wireless transceiver 218. The time delay operation mode also provides time for a user to manually press the disable button 212 in the case of a false alarm.

A wireless transceiver 218 is interconnected to the alarm control circuit 210 and includes a cellular processor with an integrated memory. The integrated memory includes preprogrammed or predetermined emergency identification data. The wireless transceiver module 218 may be configured to transmit the emergency identification data signals via a control channel and be configured with an amplifier.

The wireless transceiver 218 includes a means for directly transmitting the preprogrammed or predetermined emergency identification data to a 911 dispatch center.

In one embodiment, the wireless transceiver 218 includes an RF signal strength circuit 220 and an indicator light 222 for measuring and monitoring the strength of the RF signal.

In another embodiment, a GPS receiver module 224 is in communication with at least one of the wireless transceiver 218, alarm control circuit 210, or both. The GPS receiver module 224 is configured to provide a geographic location for the unit 202. In another embodiment, the GPS receiver module 224 may be configured for assisted GPS operation.

In yet another embodiment, an audible alarm horn 226, which may be configured to emit a continuous high decibel tone, is coupled to the alarm control circuit 210. Additionally or alternatively, a strobe light 228, configured for high candela output, may be coupled to the alarm control circuit 210. The audible alarm horn 226 and the strobe light 228 may be ADA compliant for the hearing impaired. During operation, the alarm control circuit 210 activates the audible alarm horn 226 and the strobe light 228. During the time-delay operation mode, the alarm control circuit 210 causes the audible alarm horn 226 to emit a intermittent high decibel tone for a duration of time.

In yet another embodiment, a wireless local area network ("WLAN") transceiver 230 and WLAN code selector 232 are in communication with the alarm control circuit 210. The WLAN transceiver 230 is configured to transmit and receive short-range encoded activation signals between multiple wireless transceivers. The WLAN code selector 232 includes a switch with multiple numeric code settings. The WLAN code selector allows a user to set a code to limit the WLAN activation signal transmission to other wireless transceivers that have the same numeric code setting.

Figure 3:
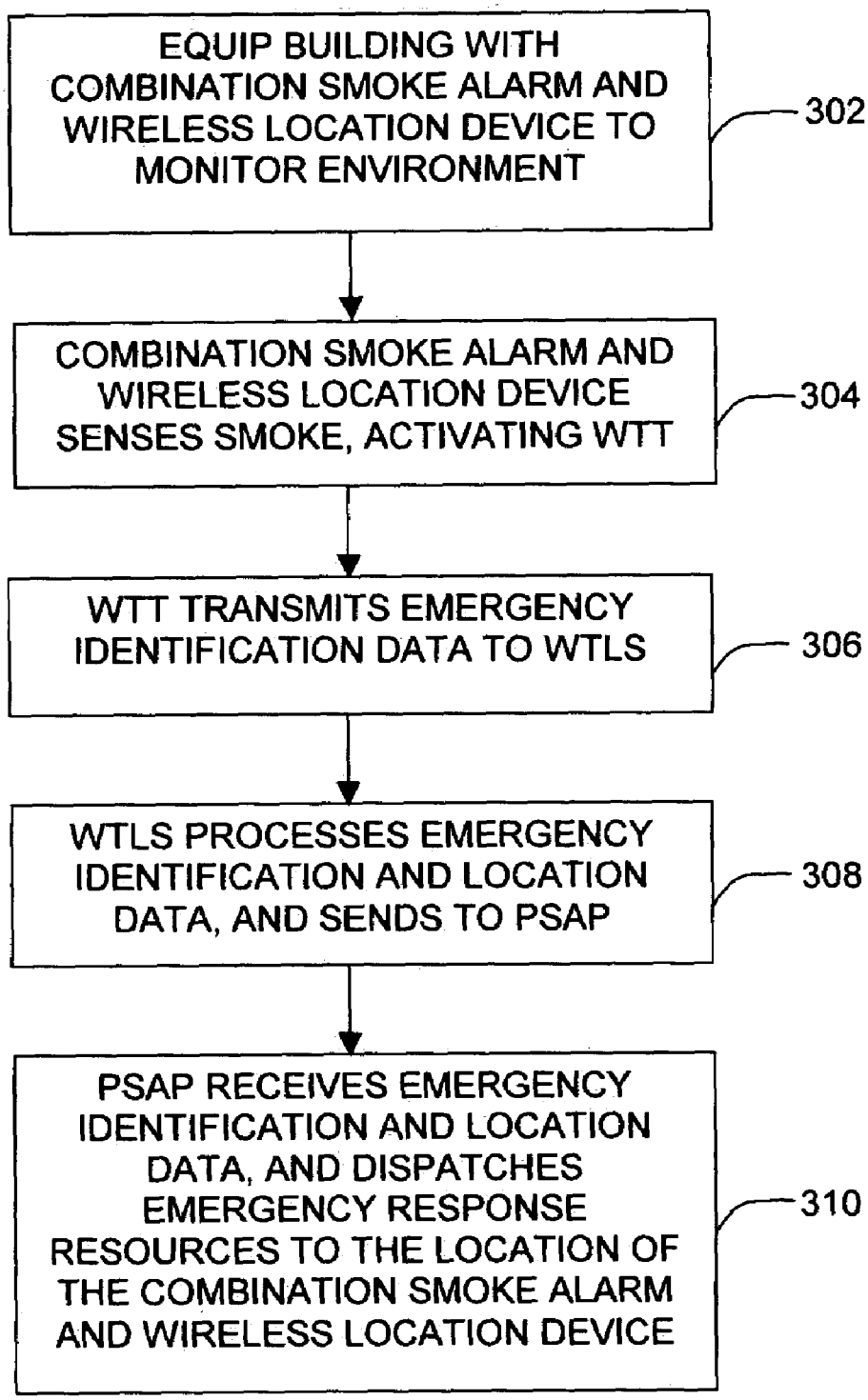
FIG. 3 is a flow chart showing a method of operation for the wireless smoke alarm according to one illustrated embodiment.

FIG. 3 is a flowchart showing a method for automatically determining a geographic location of a unit 102, and notifying a dispatch center.

In 302, a residential or commercial building is equipped with a unit 102, which monitors the building. The building may be under construction, completed, vacant, or occupied. In 304, the unit 102 senses a threshold of smoke, which activates the alarm control circuit 108 and wireless transceiver 112. Optionally, a GPS receiver may also be activated. If the building is occupied, occupants may be alerted by an audible or visual alarm from the unit 102.

In 306, the wireless transceiver "auto-dials" and transmits the emergency identification data. If a GPS receiver is integrated into the unit 102, the acquired GPS location data is also transmitted. In 308, the WTLS receives the emergency identification data, which includes the geographic location of the unit 102. In 310, the dispatch center receives the emergency identification and location data. The dispatch center may dispatch emergency response resources by various wireless communication means, including but not limited to wireless telephone, the internet, the above-mentioned WTLS, VHF/UHF radio, Enhanced Specialized Mobile Radio, SMS, MMS, or WLAN. Optionally, the emergency response personnel are equipped with mobile wireless communication and computing devices (e.g., Personal Digital Assistants, mobile cellular telephones, or mobile lap-top computers), utilizing the above wireless communication means. Thus, the emergency response personnel may directly receive the emergency identification and location data and then respond to the geographic location of the unit 102.

Figure 4:
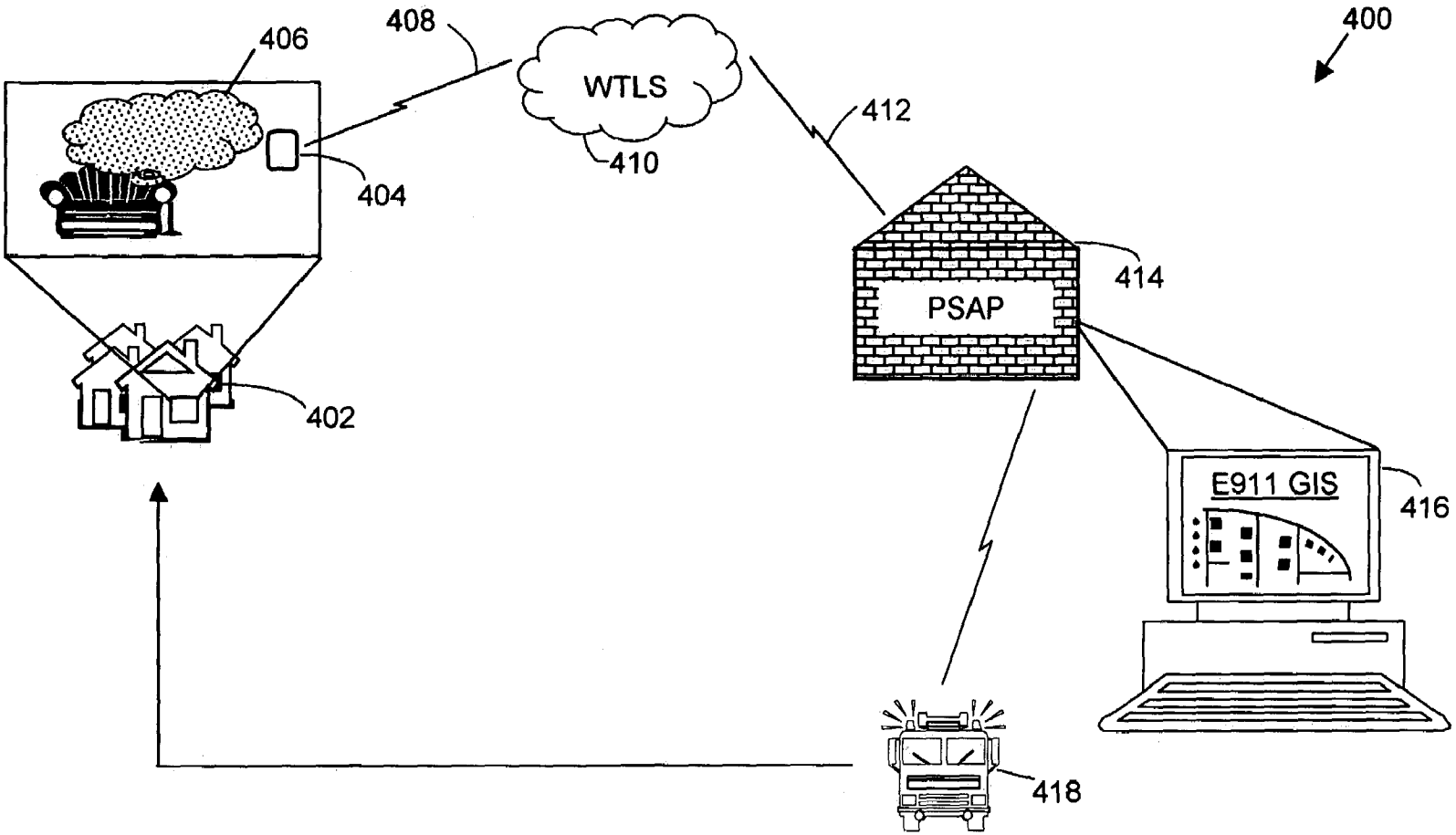
FIG. 4 shows a schematic wireless smoke alarm in operation according to one illustrated embodiment.

FIG. 4 shows one schematic example of using the aforementioned components according to at least one embodiment described herein. FIG. 4 shows an environment 400 having a residential building 402 equipped with a wireless smoke alarm 404.

Upon sensing a threshold of smoke 406 within the building 402, the wireless smoke alarm 404 transmits emergency identification data 408. In the illustrated embodiment, a WTLS 410 processes and then routes the emergency identification data 412 to a dispatch center 414 (e.g., PSAP). The dispatch center 414 includes a GIS display 416, which illustratively maps the geographic location of the building 402 and wireless smoke alarm 404.

The various embodiments described above can be combined to provide further embodiments. All of the above U.S. patents, patent applications and publications referred to in this specification are incorporated herein by reference, to include U.S. Pat. No. 6,362,743; U.S. Pat. No. 5,587,805; U.S. Pat. No. 5,019,805; U.S. Pat. No. 6,317,604; U.S. Pat. No. 6,184,829; U.S. Pat. No. 6,353,412; U.S. Pat. No. 6,323,803; U.S. Provisional Patent Application No. 60/416,970; and U.S. Provisional Patent Application No. 60/416,971. Aspects of the various embodiments can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all optical scanning and/or optical reading devices that operate in accordance with the claims. Accordingly, the invention is not limited by the disclosure, but instead its scope is to be determined entirely by the following claims.

We claim:

1. A smoke alarm device comprising:

a smoke sensor to sense a threshold level of smoke;

an alarm control circuit in communication with the smoke sensor, the alarm control circuit configured to generate a signal in response to the smoke sensor sensing the threshold level of smoke;

a wireless transceiver having an integrated memory that includes an enhanced wireless 911 feature with emergency identification data, the transceiver coupled to the alarm control circuit to automatically transmit the emergency identification data to a dispatch center upon receiving the signal from the alarm control circuit, wherein the emergency identification data includes a geographic location of the wireless transceiver; and a time delay control circuit to temporarily delay a transmission of the signal from the control circuit to the wireless transceiver.

2. The smoke alarm device of claim 1, further comprising:

a Global Positioning System (GPS) receiver in communication with the wireless transceiver.

3. The smoke alarm device of claim 1 wherein the emergency identification data is encoded.

4. The smoke alarm device of claim 1, further comprising:

a strobe light coupled with the alarm control circuit to generate a visual alarm.

5. The smoke alarm device of claim 1, further comprising:

a radio frequency signal strength indicator light located within the wireless transceiver to measure a signal strength.

6. The smoke alarm device of claim 1, further comprising:

a disable means for temporarily disabling at least one function of the alarm control circuit.

7. The smoke alarm device of claim 1 wherein the geographic location of the device is accurate to within a range of about 0–300 meters.

8. A wireless smoke alarm to transmit data to a dispatch center, the alarm comprising:

an integrated memory having an enhanced wireless 911 service;

a sensor configured to generate a signal when an amount of smoke is detected;

an alarm control circuit in communication with the sensor and configured to receive the signal from the sensor;

a transmitter in communication with the integrated memory and the alarm control circuit, the transmitter configured to automatically and contemporaneously transmit at least a geographic location of the wireless smoke alarm to a dispatch center when the alarm control circuit is activated; and an alarm disabling mechanism to at least temporarily disable the alarm control circuit, wherein the alarm disabling mechanism is configured to be inoperative beyond a number of uses.

9. A wireless smoke alarm to transmit data to a dispatch center, the alarm comprising:

an integrated memory having an enhanced wireless 911 service;

a sensor configured to generate a signal when an amount of smoke is detected;

an alarm control circuit in communication with the sensor and configured to receive the signal from the sensor;

a transmitter in communication with the integrated memory and the alarm control circuit, the transmitter configured to automatically and contemporaneously transmit at least a geographic location of the wireless smoke alarm to a dispatch center when the alarm control circuit is activated; and a time delay control circuit to temporarily delay a transmission of the signal to the transmitter.

10. The wireless smoke alarm of claim 9 wherein the geographic location of the wireless smoke alarm is determined by a global positioning system in communication with the integrated memory.

11. The wireless smoke alarm of claim 9 wherein the geographic location of the wireless smoke alarm is stored in the integrated memory.

12. The wireless smoke alarm of claim 9 wherein the transmitter coupled with the integrated memory comprises a cellular telephone.

13. The wireless smoke alarm of claim 9, further comprising:

a housing encompassing the integrated memory, the smoke sensor, the alarm control circuit, and the transmitter.

14. The wireless smoke alarm of claim 9, further comprising:

a serial number stored in the integrated memory.

15. The wireless smoke alarm of claim 14 wherein the transmitter is further configured to transmit the serial number.

16. The wireless smoke alarm of claim 9 wherein the alarm control circuit is coupled to an audible alarm that activates when signal is received from the sensor.

17. The wireless smoke alarm of claim 9 wherein the alarm control circuit is coupled to a visual alarm that activates when signal is received from the sensor.

18. The wireless smoke alarm of claim 17 wherein the visual alarm is a strobe light.

19. The wireless smoke alarm of claim 9, further comprising:

an audible alarm horn configured to emit a high decibel tone is coupled to the alarm control circuit.

20. A wireless smoke alarm system comprising:

a wireless telecommunication transceiver having a radio frequency signal strength circuit and a radio frequency light emitting diode;

a wireless local area network having a code selector;

an alarm control circuit in communication with the wireless telecommunication transceiver and the wireless local area network, the alarm control circuit in communication with an alarm horn, a strobe light, an alarm disable, and a time delay circuit, wherein the time delay circuit includes a time delay selector;

a smoke sensor coupled to the alarm control circuit, the smoke sensor configured to send a signal to the alarm control circuit in response to detecting a level of smoke; and a power supply coupled to the wireless telecommunication transceiver and to the smoke sensor.

* * * * *